US006948713B1

(12) United States Patent
Grunfeld

(10) Patent No.: US 6,948,713 B1
(45) Date of Patent: Sep. 27, 2005

(54) FLYING DISK TARGET ASSEMBLY FOR ENGAGING AND CATCHING FLYING DISK

(76) Inventor: Dan Grunfeld, 1360 Bellaire, Denver, CO (US) 80220

( * ) Notice: Subject to any disclaimer, the term of this patent is extended or adjusted under 35 U.S.C. 154(b) by 61 days.

(21) Appl. No.: 10/718,457

(22) Filed: Nov. 19, 2003

(51) Int. Cl.[7] ..... A63B 67/06
(52) U.S. Cl. ..... 273/400; 473/476
(58) Field of Search ..... 273/398–402, 273/407; 473/479, 481

(56) References Cited

U.S. PATENT DOCUMENTS 4,461,484 A * 7/1984 Headrick ..... 273/400
4,792,143 A * 12/1988 Headrick ..... 273/400
4,940,232 A * 7/1990 Chen ..... 473/416
5,048,845 A * 9/1991 Dunipace ..... 273/400
5,358,255 A * 10/1994 Jolson ..... 273/400
5,868,395 A * 2/1999 Headrick ..... 273/400
5,921,551 A * 7/1999 Dunipace ..... 273/400
6,250,635 B1 * 6/2001 Chittenden ..... 273/400
6,419,596 B1 * 7/2002 Dadbeh ..... 473/481
6,468,165 B1 * 10/2002 Moore ..... 473/170
6,494,455 B1 * 12/2002 Headrick ..... 273/400
6,554,285 B2 * 4/2003 Chittenden ..... 273/400
6,776,417 B1 * 8/2004 Holgate ..... 273/400
6,808,176 B2 * 10/2004 Billig et al. ..... 273/400

* cited by examiner

*Primary Examiner*—Mark S. Graham
(74) *Attorney, Agent, or Firm*—Edwin H. Crabtree; Ramon L. Pizarro; Donald W. Margolis

(57) ABSTRACT

A flying disk target assembly used as a target in flying disk golf. The assembly includes a strut assembly attached to a vertical lower pole. The lower pole is received inside a basket sleeve centered on an open top basket. The sleeve is attached to an upper pole. The upper pole is received inside a chain and net assembly. The assembly includes an upper chain and net ring with ring sleeve is received on top of the upper pole for suspending the assembly. The upper chain and net ring is used for suspending a plurality of chains and a net. A weighted lower chain and net ring is attached to a bottom of the chains and the net. The lower chain and net ring includes a floating sleeve. When a flying disk hits the chains and/or the net, the floating sleeve acts as a shock absorber.

20 Claims, 3 Drawing Sheets

FLYING DISK TARGET ASSEMBLY FOR ENGAGING AND CATCHING FLYING DISK

BACKGROUND OF THE INVENTION (a) Field of the Invention

This invention relates to a game of flying disk golf and more particularly, but not by way of limitation, the use of a flying disk target assembly used as a target in flying disk golf. The new flying disk target assembly provides for effectively engaging and stopping the flight of a flying disk and allowing the disk to be dropped by gravity into an open top disk basket mounted on an upright pole.

(b) Discussion of Prior Art

Heretofore, there have been a variety of different types of flying disk targets and flying disk entrapment devices used in the game of flying disk golf. In U.S. Pat. Nos. 6,494,455, 5,868,395, 4,792,143, 4,461,484 and 4,039,189 to Headrick, the use of a pole mounted flying disk entrapment device is disclosed using a plurality of vertically mounted chains. The chains are used for engaging and entrapping a flying disk. The mounted chains suspended above an open top basket mounted on a pole.

In U.S. Pat. No. 6,250,635 to Chittenden, a disc golf target is described using chains supported from curved support members. The curved support members are disposed above a disk-receiving basket mounted on an upright stand. In U.S. Pat. No. 5,921,551 to Dunipace, another disc golf target is disclosed having a chain rack. The chain rack is used to suspend a plurality of outer and inner chains. The chains are disposed above a pole mounted basket. In U.S. Pat. No. 5,358,255 to Jolsen, a disc catching apparatus is illustrated having flexible chains, an open top basket and a top housing having one or more lamps. The lamps are used to light up the disc catching apparatus.

None of the above-mentioned prior art patents specifically disclose the unique features, structure and function of the subject flying disk target assembly as described herein.

SUMMARY OF THE INVENTION

In view of the foregoing, it is a primary objective of the subject invention to provide an improved flying disk target assembly that more effectively engages and stops the momentum of the flight of a flying disk for dropping the disk by gravity into an open top basket. The basket is mounted on an upright vertical pole.

Another object of the invention is the use of a combination of a plurality of vertically mounted chains and a net. The net is disposed next to and inside the chains. The chains and net are used for absorbing the kinetic energy of a flying disc. Also, the net is used to engage any disk that might heretofore pass between the suspended chains and thus not be engaged and dropped into the open top basket.

Yet another object of flying disk target assembly is the vertically mounted chains and net are attached to a lower chain and net ring with a weighted floating sleeve. The floating sleeve is disposed around the upright pole. The floating sleeve acts as a shock absorber for slowing and stopping the flight of the flying disk when the flying disk engages the chains and/or the net.

Still another object of the invention is the target assembly is portable, lightweight, rugged in construction and can be quickly assembled and disassembled.

A further object of the flying disc assembly is it's adaptability for mounting vertically on various types of slopping ground terrain.

The flying disk target assembly includes a strut assembly attached to a lower portion of a vertical lower pole. An upper portion of the lower pole is received inside a basket sleeve. The basket sleeve is centered inside an open top basket. An upper portion of the basket sleeve receives a lower portion of a vertical upper pole. The upper pole is received inside a chain and net assembly. The chain and net assembly includes an upper chain and net ring with ring sleeve and cap. The ring sleeve is received around a top portion of the upper pole for suspending the chain and net assembly thereon. The upper chain and net ring is used for suspending a plurality of chains and a net therefrom. A weighted lower chain and net ring is attached to a bottom of the chains and the net for suspending them in tension. The lower chain and net ring includes a floating sleeve centered thereon. The floating sleeve is received around a portion of the basket sleeve. When a flying disk hits the chains and/or the net, the floating sleeve acts as a shock absorber for absorbing the kinetic energy of the disk and stopping it's flight. The flying disk then drops by gravity into the top of the open top basket for providing a flying disk score.

These and other objects of the present invention will become apparent to those familiar with various types of flying disk targets and flying disk golf when reviewing the following detailed description, showing novel construction, combination, and elements as herein described, and more particularly defined by the claims, it being understood that changes in the various embodiments of invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
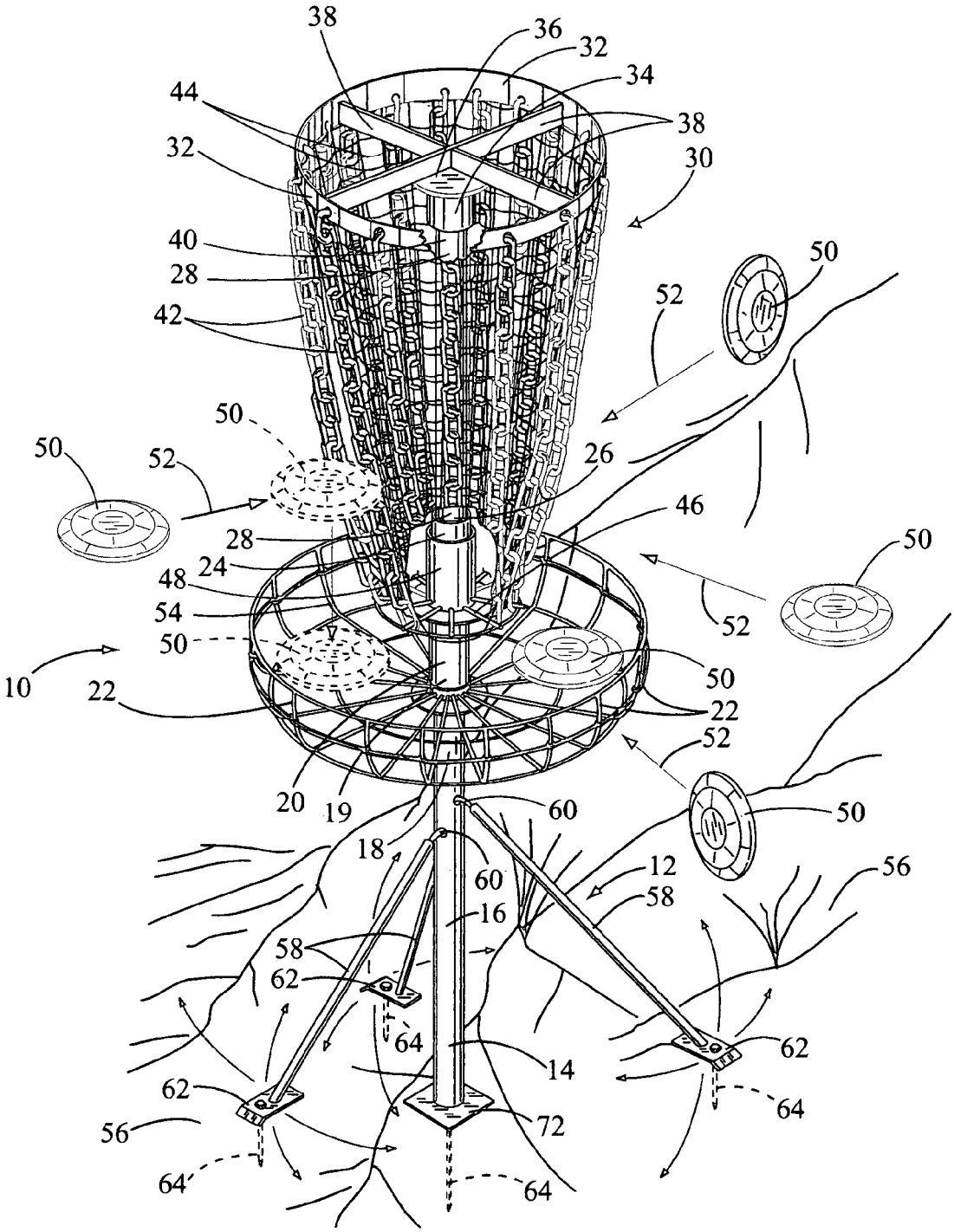
FIG. 1 illustrates a perspective view of the flying disk target assembly with a strut assembly holding the target assembly's lower and upper poles upright in a vertical position on an uneven ground surface.

In FIG. 1, a perspective view of the flying disk target assembly is shown having general reference numeral 10. The flying disk target assembly 10 includes a strut assembly, having a general reference numeral 12, attached to a lower portion 14 of a vertical lower pole 16. An upper portion 18 of the lower pole 16 is received inside a lower portion 19 of a basket sleeve 20. The basket sleeve 20 is centered inside an open top basket 22. An upper portion 24 of the basket sleeve 20 receives a lower portion 26 of a vertical upper pole 28. The upper pole 28 is received inside a chain and net assembly, having a general reference numeral 30.

The chain and net assembly 30 includes an upper chain and net ring 32 with a ring sleeve 34 attached to the bottom of a ring cap 36. The cap 36 and chain and net ring 32 are attached to opposite ends of ring supports 38. The ring sleeve 34 is received around a top portion 40 of the upper pole 28, with the cap 36 engaging the top of the pole 28. The upper pole 28 is used for suspending the chain and net assembly 30 thereon. The upper chain and net ring 32 is used for suspending a plurality of chains 42 and a net 44 therefrom.

A weighted lower chain and net ring 46 is attached to a bottom of the chains 42 and the net 44 for suspending them in tension. The lower chain and net ring 46 includes a floating sleeve 48 centered thereon. The floating sleeve 48 is received around a portion of the basket sleeve 28 for sliding upwardly and downwardly thereon. In this drawing, portions of the chain and net assembly 30 have been cut-away to illustrate the lower portion 26 of the upper pole 28 inserted into the upper portion 24 of the basket sleeve 20 and the upper portion 40 of the upper pole 28 inserted into the ring sleeve 34 of the upper chain and net ring 32.

When one or more flying disks 50 hit the chains 42 and/or the net 44, the floating sleeve 28 acts as a shock absorber for absorbing the kinetic energy of the disk 50 and stopping it's flight. The flying disk 50 then drops by gravity into the top of the open top basket 22 for providing a flying disk score. It should be mentioned again that prior art flying disk target assemblies using vertically suspended chains quite often will have a flying disk pass between the chains when the disk is in a vertical position or close thereto thus failing to engage and capture the flying disk for a flying disk score. In the subject invention, should the flying disk 50 be in a vertical flight mode as shown in the upper right hand corner of FIG. 1, the disk 50 may avoid engaging the vertically mounted chains 42 but not the net 44, which will engage and stop the flight of the disk prior to allowing it to drop into the top of the open top basket 22.

In this drawing, a number of flying disks 50 are shown in flight heading toward the target assembly 10, as indicated by arrows 52. Also, one of the disks 50 is shown engaging the chain and net assembly 30 and dropping into the top of the basket 22, as indicated by arrow 54.

Figure 2:
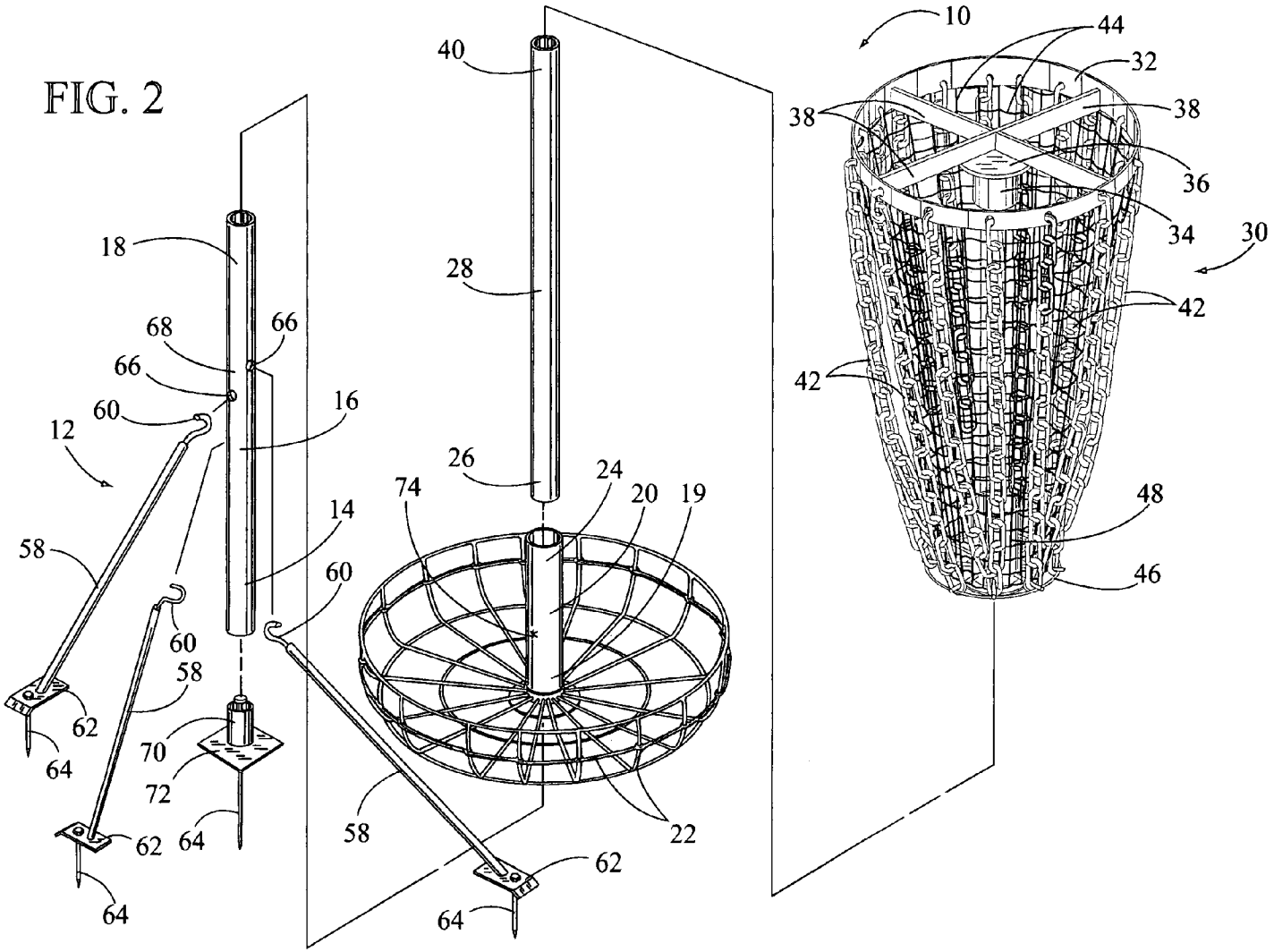
FIG. 2 illustrates an exploded view of the flying disk target assembly showing the strut assembly, the lower pole, the upper pole, an open top basket with basket sleeve and a chain and net assembly with a lower chain and net ring with floating sleeve.

In FIG. 2, an exploded view of the flying disk target assembly 10 is shown illustrating its various components. The strut assembly 12 is designed to hold the target assembly 10 in an upright vertical position on a flat or uneven ground surface 56, as shown in FIG. 1. The strut assembly 12 includes three strut arms 58 with strut hooks 60 mounted on upper ends of the arms and strut plates 62 mounted on the lower ends. The strut plates 62 include holes therein for receiving ground spikes 64 therethrough and into the ground surface 56. The lower pole 16 includes three holes 66 spaced 120 degrees around a center portion 68 of the lower pole. The holes 66 are used for receiving the strut hooks 60 therein for holding the lower pole 16 upright in a vertical position.

To help insure that the target assembly 10 is held securely on different types of the ground surface 56, an anchor plate sleeve 70 is attached to the top of a ground anchor plate 72. An elongated ground spike 64 is received through the top of anchor plate sleeve 70 and through the anchor plate 72 and attached thereto. The top of the ground spike 64 extends above the top of the anchor plate sleeve 70 and is used with a hammer for driving the spike 64 into the ground with the ground anchor plate 72 engaging the top of the ground surface. When the ground anchor plate 72 is in place, the lower portion 14 of the lower pole 16 is inserted around the anchor plate sleeve 70.

During the installation of the target assembly 10 and once the strut assembly 12 and lower pole 16 are in place on the ground surface 56, the basket sleeve 20 is lowered around the top portion 18 of the lower pole 16. As the lower pole 16 is received inside lower portion 19 of the basket sleeve 20, the top of the lower pole 16 engages a dimple 74, which is centered along the length of the basket sleeve 20. Obviously, the dimple 74 acts as a stop to limit the travel of the lower pole 16 inside the basket sleeve 20. When the open top basket 22 is in place, the lower portion 26 of the upper pole 28 is inserted inside the upper portion 24 of the basket sleeve until the bottom of the upper pole 28 engages the dimple 74.

Once the upper pole 28 is in place, the chain and net assembly 30 is lowered around the upper pole 28 and the floating sleeve is inserted around the upper portion 24 of the basket sleeve 20. Also, the ring sleeve 34 is placed around the top portion 40 of the upper pole 28. The flying disk target assembly 10 is now ready for flying disk play as shown in FIG. 1.

Figure 3:
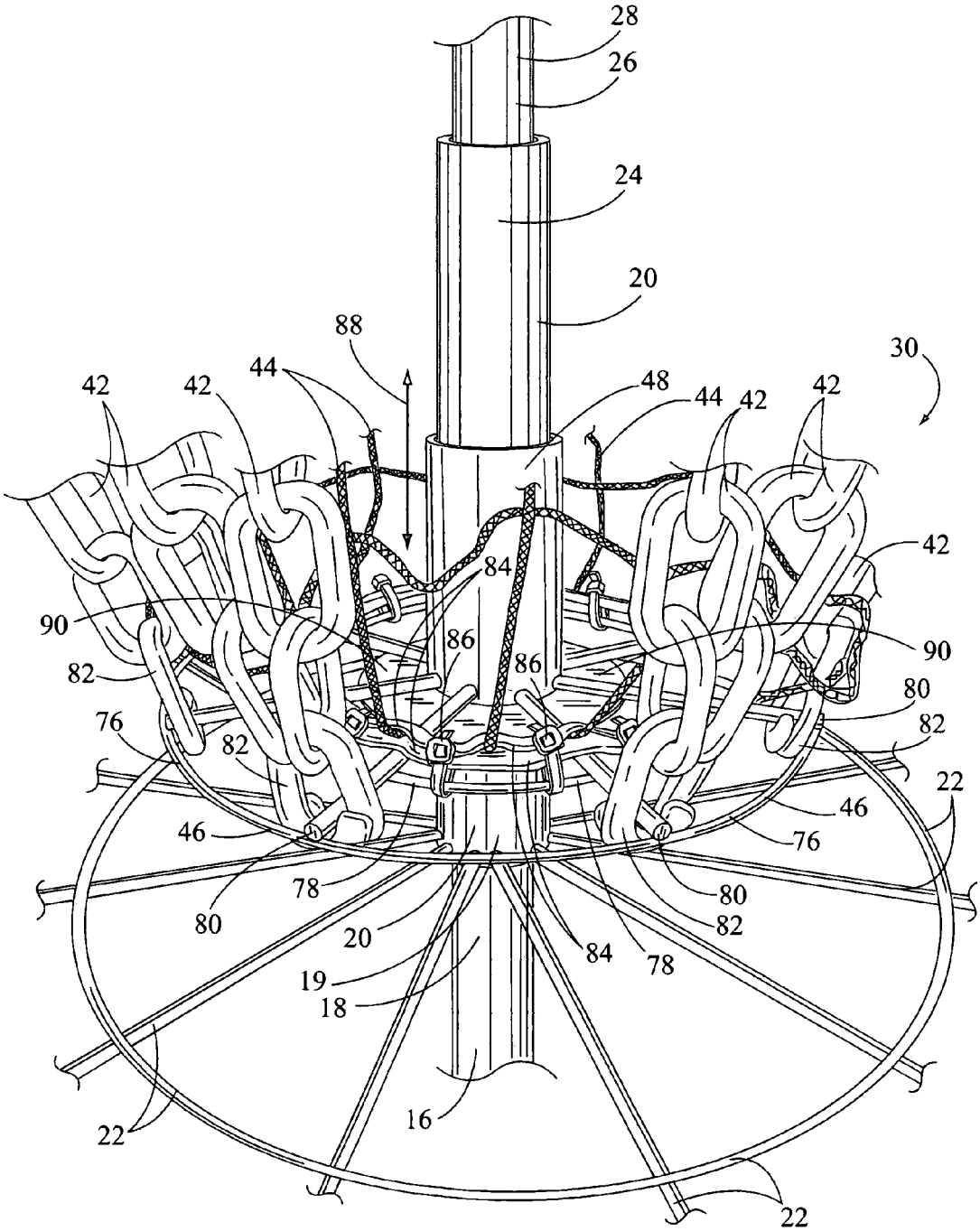
FIG. 3 is an enlarged perspective view of a portion of the open top basket, basket sleeve and the lower chain and net ring with floating sleeve.

In FIG. 3, an enlarged perspective view of a portion of the open top basket 22, the basket sleeve 20 and the lower chain and net ring 46 with floating sleeve 48 is shown. In this drawing, greater detail of the lower chain and net ring 46 is shown with an outer ring 76, an inner ring 78 and outwardly extending, spaced apart spokes 80. The spokes 80 are attached to the rings 76 and 78 and a portion of the floating sleeve 48.

A lower link 82 of each of the chains 42 is used for holding the chains on the ends of the spokes 80 and next to the outer ring 76. When the chains 42 are hit by the flying disk 50, the lower link 82 of the chains 42 is free to move inwardly on the spokes 80 for helping dampen the velocity of the disk. A lower portion of the net 44 is shown attached to the inner ring 78 using a net wrap 84 and plastic snaps 86.

As mentioned above, the floating sleeve 48 is of importance in that it acts as a shock absorber by moving up and down, as indicated by arrow 88, on the basket sleeve 20. When the chains 42 and/or net 44 are hit by a high speed flying disk 50, rather then the disk bouncing off the chain and net assembly 30 and without a golf score, the floating sleeve 20 absorbs the shock by moving quickly upwardly on the basket sleeve 20. Because the lower chain and net ring 46 is weighted, using a disk weight 90 attached to a portion of the spokes 80 next to the floating sleeve 20, it quickly moves downward on the basket sleeve 20 returning to its normal resting position prior to engaging another flying disk.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

What is claimed is:

1. A flying disk target assembly used as a target in flying disk golf, the flying disk target assembly provides for effectively engaging and stopping the flight of a flying disk and allowing the disk to be dropped by gravity for a golf score, the target assembly comprising:

an open top disk basket mounted on an upright pole; and a chain and net assembly attached to and suspended from a top of said upright pole, said chain and net assembly including a plurality of chains and a net, said chains and net adapted for engaging and stopping the flying disk and dropping it into said open top disk basket.

2. The target assembly as described in claim 1 wherein said chain and net assembly include a lower chain and net ring attached to a bottom of said chains and a bottom of said net for holding said chains and net in tension.

3. The target assembly as described in claim 2 wherein said disk basket includes a basket sleeve centered thereon and extending upwardly therefrom, said basket sleeve received around a portion of said upright pole.

4. The target assembly as described in claim 3 wherein said chain and net assembly include a floating sleeve centered on said lower chain and net ring and extending upwardly therefrom, said floating sleeve disposed around a portion of said basket sleeve, said floating sleeve adapted for upward and downward movement on said basket sleeve when the flying disk engages said chains and net.

5. The target assembly as described in claim 2 wherein said chain and net assembly include an upper chain and net ring with a ring sleeve and cap, said ring sleeve received around an upper portion of said upright pole.

6. The target assembly as described in claim 1 further including a strut assembly for engaging a lower portion of said upright pole and holding said pole in a vertical position.

7. The target assembly as described in claim 6 wherein said strut assembly includes a plurality of strut arms with strut hooks mounted on upper ends of said strut arms and strut plates mounted on lower ends of said strut arms, said strut plates include holes therein for receiving ground spikes therethrough, said strut hooks releasably attached to the lower portion of said upright pole.

8. The target assembly as described in claim 7 wherein said strut assembly includes an anchor plate sleeve attached to a top of a ground anchor plate and an elongated ground spike received through a top of said anchor plate sleeve and through said anchor plate and attached thereto, said anchor plate sleeve received inside a bottom of said upright pole.

9. A flying disk target assembly used as a target in flying disk golf and adapted for mounting on a ground surface, the flying disk target assembly provides for effectively engaging and stopping the flight of a flying disk and allowing the disk to be dropped by gravity for a golf score, the target assembly comprising:

an open top disk basket mounted on an upright pole;

a chain and net assembly attached to and suspended from a top of said upright pole, said chain and net assembly including a plurality of vertical chains and a net disposed next to and inside said chains, said chains and net adapted for engaging and stopping the flying disk and dropping it into said open top disk basket; and a lower weighted chain and net ring attached to a bottom of said chains and a bottom of said net for holding said chains and net in tension.

10. The target assembly as described in claim 9 wherein said disk basket includes a basket sleeve centered thereon and extending upwardly therefrom, said basket sleeve received around a center portion of said upright pole.

11. The target assembly as described in claim 10 wherein said chain and net assembly include a floating sleeve centered on said lower chain and net ring and extending upwardly therefrom, said floating sleeve disposed around a portion of said basket sleeve, said floating sleeve adapted for upward movement when said chains and net are engaged by a flying disk and downward movement on said basket sleeve after said chains and net stop the flight of the flying disk.

12. The target assembly as described in claim 10 wherein said chain and net assembly include an upper chain and net ring with a ring sleeve and cap, said ring sleeve received around an upper portion of said upright pole and said cap is received on top of said upright pole.

13. The target assembly as described in claim 9 further including a strut assembly for engaging a lower portion of said upright pole and holding said pole in a vertical position.

14. The target assembly as described in claim 13 wherein said strut assembly includes a plurality of strut arms with strut hooks mounted on upper ends of said strut arms and strut plates mounted on lower ends of said strut arms, said strut plates include holes therein for receiving ground spikes therethrough, said strut hooks releasably attached inside spaced apart holes in the lower portion of said upright pole.

15. The target assembly as described in claim 14 wherein said strut assembly includes an anchor plate sleeve attached to a top of a ground anchor plate and an elongated ground spike received through a top of said anchor plate sleeve and through said anchor plate and attached thereto, said anchor plate adapted for receipt on top of the ground surface, said anchor plate sleeve received inside a bottom of said upright pole.

16. A flying disk target assembly used as a target in flying disk golf and adapted for mounting on a ground surface, the flying disk target assembly provides for effectively engaging and stopping the flight of a flying disk and allowing the disk to be dropped by gravity for a golf score, the target assembly comprising:

an open top disk basket mounted on an upright pole, said disk basket including a basket sleeve centered thereon and extending upwardly therefrom, said basket sleeve received around a center portion of said upright pole;

a chain and net assembly attached to and suspended from a top of said upright pole, said chain and net assembly including a plurality of vertical chains and a net disposed next to and inside said chains, said chains and net adapted for engaging and stopping the flying disk and dropping it into said open top disk basket; and a lower weighed chain and net ring attached to a bottom of said chains and a bottom of said net for holding said chains and net in tension, said chain and net ring including a floating sleeve centered thereon and extending upwardly therefrom, said floating sleeve disposed around a portion of said basket sleeve, said floating sleeve adapted for upward movement and downward movement on said basket sleeve.

17. The target assembly as described in claim 16 wherein said chain and net assembly include an upper chain and net ring with a ring sleeve and cap, said ring sleeve received around an upper portion of said upright pole and said cap is received on top of said upright pole.

18. The target assembly as described in claim 16 further including a strut assembly for engaging a lower portion of said upright pole and holding said pole in a vertical position.

19. The target assembly as described in claim 18 wherein said strut assembly includes a plurality of strut arms with strut hooks mounted on upper ends of said strut arms and strut plates mounted on lower ends of said strut arms, said strut plates include holes therein for receiving ground spikes therethrough, said strut hooks releasably attached inside spaced apart holes in the lower portion of said upright pole.

20. The target assembly as described in claim 18 wherein said strut assembly includes an anchor plate sleeve attached to a top of a ground anchor plate and an elongated ground spike received through a top of said anchor plate sleeve and through said anchor plate and attached thereto, said anchor plate adapted for receipt on top of the ground surface, said anchor plate sleeve received inside a bottom of said upright pole.

* * * * *